United States Patent [19]

Tyner

[11] 4,312,304

[45] Jan. 26, 1982

[54] V-ENGINE COOLING SYSTEM PARTICULARLY FOR OUTBOARD MOTORS

[75] Inventor: Alfred E. Tyner, Fond du Lac, Wis.

[73] Assignee: Brunswick Corporation, Skokie, Ill.

[21] Appl. No.: 64,119

[22] Filed: Aug. 6, 1979

[51] Int. Cl.[3] ..... F01P 3/02

[52] U.S. Cl. ..... 123/41.74; 123/41.31; 123/55 VS; 123/73 A

[58] Field of Search ..... 123/41.31, 41.44, 41.47, 123/41.72, 41.74, 41.75, 41.82 R, 55 VS, 55 VX, 55 VF, 55 VE, 73 R, 73 A

[56] References Cited

U.S. PATENT DOCUMENTS

| | | | |
|---|---|---|---|
| 1,454,315 | 5/1923 | Cushman | 123/41.44 |
| 2,152,594 | 3/1939 | Klotsch | 123/41.31 |
| 2,504,973 | 4/1950 | Gehres | 123/41.31 |
| 2,627,256 | 2/1953 | Kiekhaefer | 123/41.79 |
| 2,635,592 | 4/1953 | Hollis | 123/41.72 |
| 4,082,068 | 4/1978 | Hale | 123/41.82 R |
| 4,191,156 | 3/1980 | Doveri | 123/41.72 |
| 4,212,281 | 7/1980 | Ernest | 123/41.72 |

FOREIGN PATENT DOCUMENTS

| | | |
|---|---|---|
| 684534 | 12/1952 | United Kingdom . |
| 1477595 | 6/1977 | United Kingdom . |
| 1488438 | 10/1977 | United Kingdom . |

*Primary Examiner*—Craig R. Feinberg
*Assistant Examiner*—W. R. Wolfe
*Attorney, Agent, or Firm*—O. T. Sessions

[57] ABSTRACT

In a water cooled, two-cycle, crankcase compression, V-6, outboard motor engine, cooling passages are provided on the outside of the V, near the crankcase. The engine uses an exhaust manifold cooling jacket to preheat the coolant before supplying it to the engine block cooling passages.

8 Claims, 6 Drawing Figures

V-ENGINE COOLING SYSTEM PARTICULARLY FOR OUTBOARD MOTORS

BACKGROUND OF THE INVENTION

This invention relates to an internal combustion engine and particularly to a water cooling system for a two-cycle crankcase compression V-engine for use in outboard motors.

Outboard motor engines are generally water cooled with the cooling water pumped from and returned to the body of water through which the motor is operating. The pump provides a relatively high flow of water through the engine, with the pressure and flow rate directly related to the engine speed. The pump must provide sufficient cooling flow to keep the engine temperature relatively low under full load conditions. Generally prior art engines have used water pumps developing maximum pressures of approximately 20 psi at full throttle. One such prior art engine is disclosed in U.S. Pat. No. 4,082,068 to Hale, entitled *V-Engine Cooling System Particularly for Outboard Motors and the Like.*

Though such high pressure cooling systems are general satisfactory, it is recognized that higher pressure shortens pump life and increases the incidence of cooling system leakage.

SUMMARY OF THE INVENTION

In a water cooled, two-cycle, crankcase compression, V-block, outboard motor engine, cooling jackets are provided on the outside of the block near the crankcase. Cooling water is supplied to an exhaust manifold cooling jacket to preheat the water before passing it to the central core, cylinder, and head cooling passages.

DESCRIPTION OF THE PREFERRED EMBODIMENT

Figure 1:
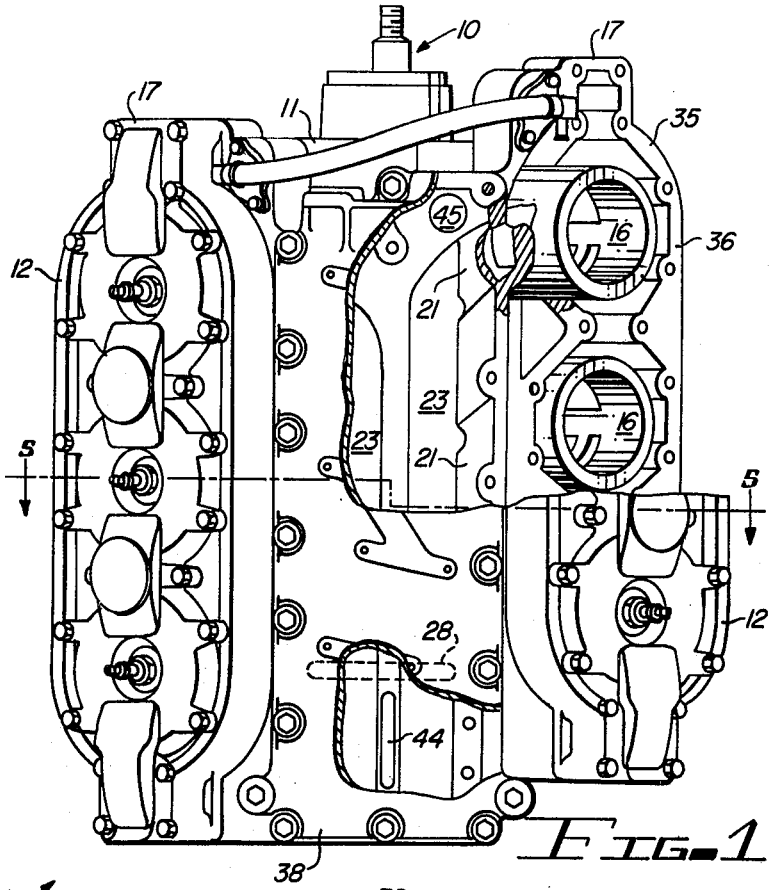
FIG. 1 is a broken away rear view of an engine.
Figure 2:
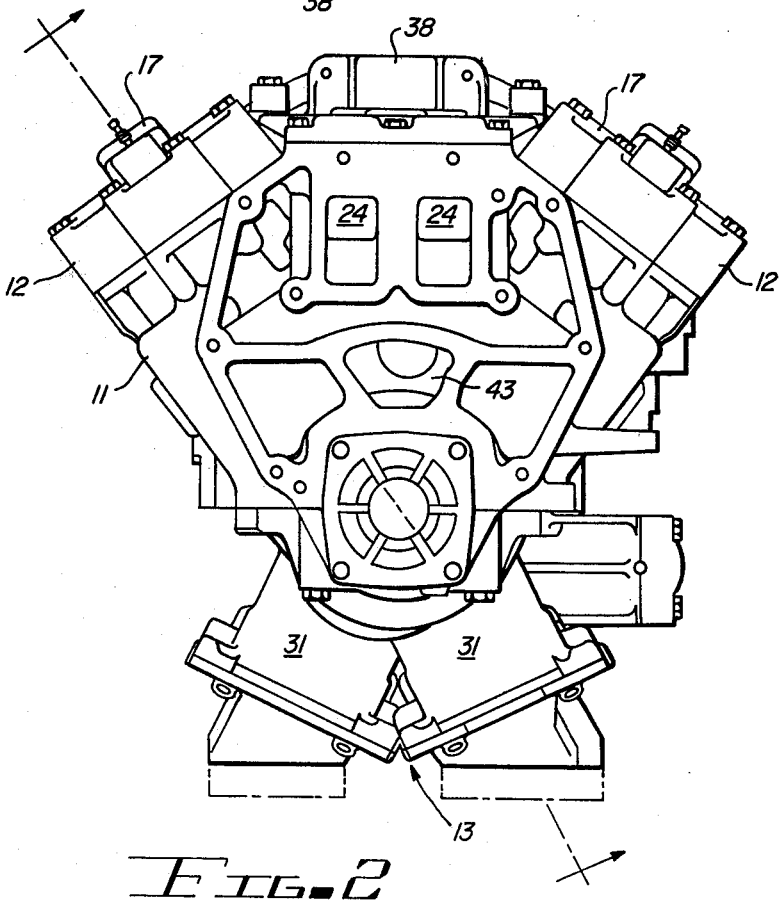
FIG. 2 is a bottom view of the engine.
Figure 3:
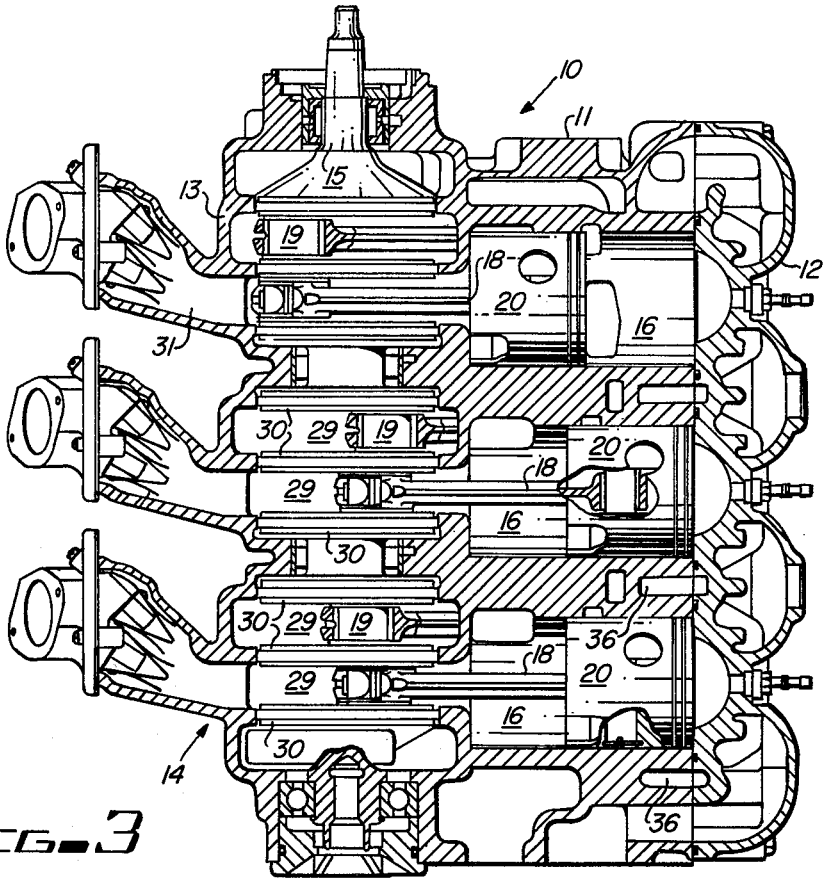
FIG. 3 is a section of the engine taken on line 3—3 of FIG. 2.

The figures illustrate a two-cycle, V-6 engine 10 particularly designed for use in an outboard motor. The engine includes a cylinder block 11 having two cylinder heads 12 and an intake manifold casting 13 defining, with the base or apex of the block, a crankcase 14 within which a crankshaft 15 is rotatably mounted. The cylinder block 11 is sand cast and includes six cylinders 16 arranged in two banks 17 forming a 74° V, the two banks 17 being vertically offset with respect to each other to offset the connecting rods 18. The rods 18 are journalled on crank pins 19 of the crankshaft 15 and pinned to the pistons 20.

The integral sand cast aluminum block 11 has an integrally cast tuned exhaust system including a port extender 21 from the exhaust port 22 of each cylinder 16, the extenders 21 from each cylinder bank 17 connecting to a corresponding exhaust gas chamber 23. The exhaust gas chambers 23 open downwardly, through openings 24 at the bottom of the block 11, and discharge into exhaust passages in the lower unit of the outboard motor, not shown. Web 25 formed between the two exhaust chambers 23 and webs 26 between the exhaust chambers 23 and their corresponding cylinder banks 17 form a core passageway 27 through the engine block. The core passageway 27 is blocked near its lower end by a dam 28, shown in broken line in FIG. 1, cast integrally with the block 11. The engine block 11 is sand cast from aluminum using sand cores. Each exhaust gas chamber 23 and its corresponding port extender passages 21 are formed using a single core. Thus the engine 10 is not susceptible to damage from water leakage into the exhaust system.

The crankcase 14 is divided into compartments 29, one for each cylinder 16, by the crank-disks 30 on the crankshaft 15 which support the crank pins 19. Each compartment 29 is provided with its own valved inlet passageway 31 to supply air-fuel mixture from carburetors, not shown, to be compressed in the crankcase compartments 29. From the crankcase 14 the air-fuel mixture is directed to the cylinders 16 via the transfer ports 32, 33 and 34, arranged to provide loop scavenging as taught in U.S. Pat. No. 4,092,958 to Hale.

Since operation of the engine 10 generates substantial heat, a water cooling system is provided with cooling passages arranged to provide a relatively even temperature distribution throughout the engine block 11 and cylinder heads 12. In the preferred embodiment, each cylinder bank 17 is provided with an outer wall 35 encircling the cylinder bank and closed by the heads 12 to define upper cylinder cooling jackets 36 surrounding the head end of each cylinder 16. The lower ends of the cylinders 16 are provided with outside cooling jackets 37 located adjacent the crankcase 14 on the outside of and cast integrally with the V-block 11. These outside cooling jackets 37 extend the vertical length of the engine 10 and serve to cool the lower ends of the cylinders 16 as well as provide substantial cooling to the crankcase 14 and transfer passages 32, 33 and 34, thereby increasing the volumetric efficiency of the pumping action in the crankcase chambers 29. On the inside of the engine block 11 the lower ends of the cylinders 16 are cooled by the central core cooling passage 27, defined by the exhaust chambers 23, the lower end of cylinders 16, and the transfer passages 33, 34 and 35. A cover 38 is provided above the exhaust gas chambers to define an exhaust manifold cooling chamber 39, and cylinder head cooling chambers 40 are provided in each cylinder head 12. Thus the major heat producing areas of the engine 10 are almost completely surrounded by water jackets and passages.

Figure 4:
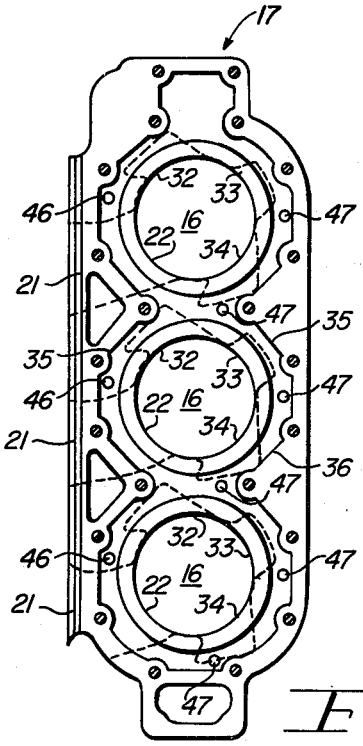
FIG. 4 is an end view of one cylinder bank with the head removed.
Figure 6:
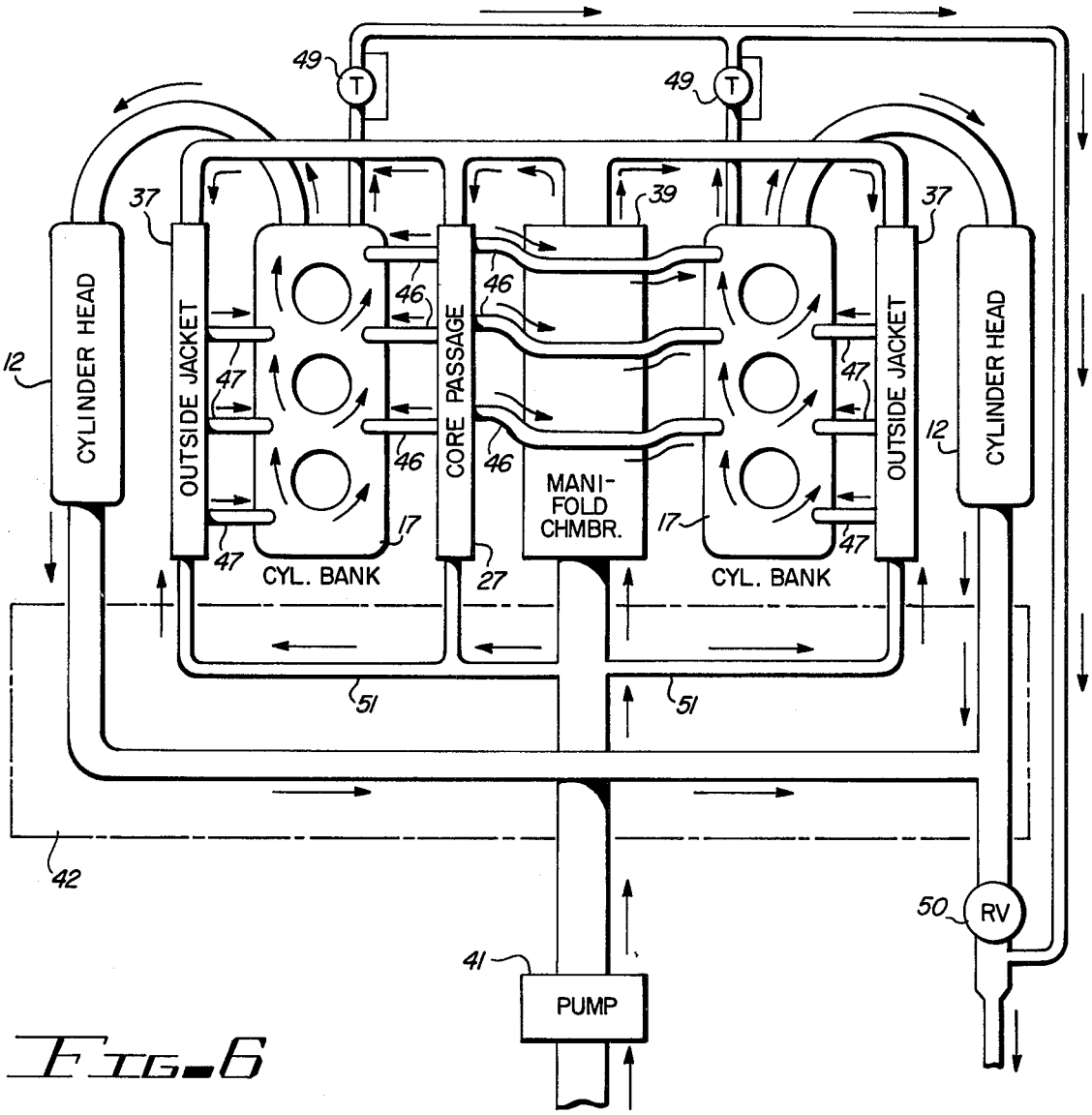
FIG. 6 is a schematic drawing of the engine coolant flow.
Figure 5:
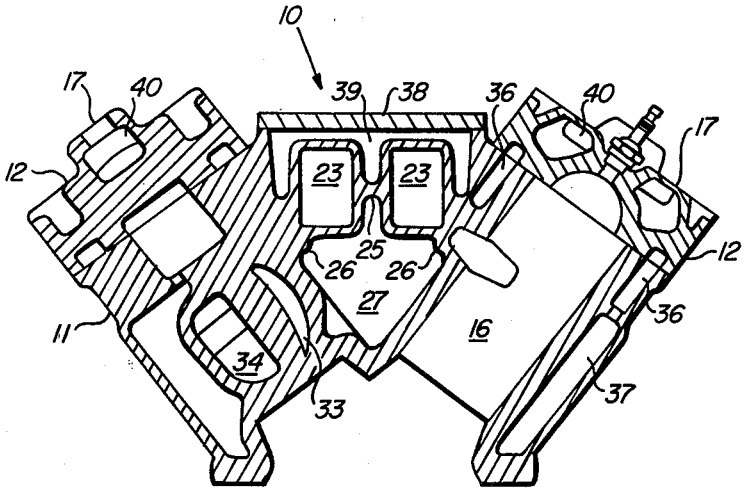
FIG. 5 is a section of the engine taken along line 5—5 of FIG. 1.

Cooling water is supplied to the engine by a conventional engine driven water pump 41, schematically illustrated in FIG. 6. The pump is connected by adapter plates 42, schematically shown in FIG. 6, to supply coolant to the engine 10. The coolant enters the engine 10 through the opening 43 at the bottom of the block below the dam 28, then flows through an opening 44 machined through the web 25 between the exhaust chambers into the exhaust manifold cooling jacket 39. After the cooling water is preheated in the manifold jacket 39, it exits the manifold jacket 39 near the top of the block 11 through drilled passages 45 into the common upper ends of the two outside cooling jackets 37 and into the central core cooling passage 27, shown most clearly in FIGS. 4 and 5.

From the central core 27 the coolant flows through passages 46 drilled through the wall separating the central core passage 27 from the upper cylinder jacket 36 The upper cylinder jacket 36 is also supplied with coolant through the passages 47 drilled through to the outside jacket 37. Though three passages 46 are shown in each cylinder bank 17 connecting the upper cylinder jacket 36 with the central core 27 and six passages connecting with the outside jackets 37 in the preferred embodiment, one of the features of the engine design is the flexibility in position and number of the drilled passages, thus allowing design flexibility in balancing the coolant flow through the engine. Further, the holes are drilled parallel to the cylinder axis for ease of fabrication. Thus a very open cooling system is provided which can be operated at significantly lower water pressure than comparable prior art engines. For example, the present engine would operate with a maximum water pressure of about 15 psi, compared to 20 psi in prior engines. This significantly increases water pump life as well as reduces the incidence of leakage.

From the upper cylinder water jackets 36 the coolant flows into the cylinder head cooling chambers 40. These chambers 40 are cast integrally with the head 12 to eliminate the possibility of leakage and are formed with passages encircling each combustion chamber and spark plug. The coolant leaves the heads 12 through the exit ports 48 and discharges through the adapter plate 42 and lower outboard motor unit, not shown.

Thermostat valves 49 and a pressure relief valve 50 serve to regulate the engine temperature under various operating conditions, as best shown in FIG. 6. An idle throttle, it is desirable to operate the engine at a higher temperature than at full throttle to minimize misfiring the erratic operation, while at full throttle the engine will operate efficiently at significantly lower temperatures. Since the output pressure of the pump 41 is directly related to the engine speed, a pressure relief valve 50 may be used to restrict coolant flow at idle while opening to provide full coolant flow at high speeds. To regulate the engine temperature at idle the thermostat valves are set to open at the desired operating temperature. Thus the engine may be run at the desired temperature, about 143° F. at idle, while running substantially cooler at full throttle.

A bleed system is provided to drain the engine of water when not operating. The bleed passages 51 are illustrated schematically in FIG. 6 and are formed as small drilled passages in the adapter plate 42. Because of their small size they do not divert enough coolant while the engine is running to significantly affect coolant flow.

I claim:

1. A water cooled, two-cycle crankcase compression, outboard motor engine having multiple cylinders arranged in two banks forming a V, a crankcase at the apex of said V, transfer passages connecting each cylinder with a corresponding crankcase compartment, an exhaust manifold positioned inside said V, and a coolant supply means, wherein the improvement comprises:

an outer cooling means for receiving coolant from said supply means and directing said cooland along said cylinders and transfer passages on the outside of said V adjacent said crankcase, with said transfer passages positioned between said outer cooling means and said cylinders; and a core cooling chamber between said banks and said exhaust manifold and a preheating means for preheating said coolant and supplying preheated coolant to said outer cooling means and said core cooling chamber.

2. The engine defined in claim 1 wherein said preheating means includes a cooling jacket on the outside of said manifold at the top of said V.

3. A water cooled, two-cycle, crankcase compression outboard motor engine comprising:

A. a cylinder block having cylinder bores arranged in two banks, said banks angularly oriented in a V-arrangement, with a transfer passage for each cylinder, said transfer passage including transfer ports for admitting air-fuel mixture to said cylinders;

B. a crankcase attached to the ends of said cylinder banks near the apex of said V, said crankcase having a plurality of crankcase compartments, each in communication with one of said transfer passages;

C. two cylinder heads secured respectively to the end of each of said cylinder banks opposite said crankcase;

D. an exhaust gas manifold between said cylinder banks;

E. a central core cooling chamber having common walls with each of said cylinder banks and said exhaust gas manifold;

F. a pair of outside cooling jackets, each one disposed on the outside of one of said cylinder banks opposite said central core cooling chamber, said outside cooling jackets positioned near the crankcase end of said cylinders with a transfer passage positioned between each of said cylinders and the corresponding outside cooling jacket;

G. coolant supply means to supply coolant directly to each of said outside cooling jackets and said central cooling chamber.

4. The engine defined in claim 3 further comprising:

H. two upper cylinder cooling jackets, each surrounding the head end of one of said cylinder banks; and I. central coolant passages connecting said upper cylinder jackets with said central cooling chamber.

5. The engine defined in claim 4 further comprising:

J. outer coolant passages connecting each of said upper cylinder cooling jackets with one of said outside cooling jackets.

6. The engine defined in claim 5 further comprising:

K. an exhaust manifold cooling jacket adjacent said exhaust manifold on the side opposite said central cooling chamber, and wherein said coolant supply means supplies coolant to said manifold cooling jacket.

7. The engine defined in claim 5 wherein said central coolant passages and said outer coolant passages are cylindrical bores parallel to the axes of their corresponding cylinders.

8. The engine defined in claim 5 further comprising:

L. two cylinder head cooling chambers, one in each of said cylinder heads; and

M. head coolant passages connecting each of said head cooling chambers with one of said upper cylinder cooling jackets.

* * * * *